US010000322B2

(12) United States Patent
Nowacki et al.

(10) Patent No.: US 10,000,322 B2
(45) Date of Patent: Jun. 19, 2018

(54) HANG TAG FOR DISPLAYING AN OBJECT

(71) Applicant: Robert Bosch Tool Corporation, Mount Prospect, IL (US)

(72) Inventors: Chris Nowacki, Lake Barrington, IL (US); Adrian Vagnoni, Battle Creek, MI (US); Simone Bosatelli, Stuttgart (DE); Dominic Winkler, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/251,928

(22) Filed: Aug. 30, 2016

(65) Prior Publication Data

US 2018/0002088 A1 Jan. 4, 2018

Related U.S. Application Data

(60) Provisional application No. 62/356,977, filed on Jun. 30, 2016.

(51) Int. Cl.

| | |
|---|---|
| ***B65D 73/00*** | (2006.01) |
| ***B65D 85/24*** | (2006.01) |
| ***B25H 3/00*** | (2006.01) |

(52) U.S. Cl.

CPC ..... *B65D 73/0064* (2013.01); *B25H 3/003* (2013.01); *B65D 85/24* (2013.01)

(58) Field of Classification Search

CPC ..... B25H 7/00; B25H 7/003; B65D 73/00; B65D 73/0024; B65D 85/20; B65D 85/24; B65D 85/28; B65D 73/0064

USPC ..... 206/349, 378, 379, 806; 211/70.6

See application file for complete search history.

(56) References Cited

U.S. PATENT DOCUMENTS

| | | | | |
|---|---|---|---|---|
| 4,171,050 | A | 10/1979 | Murray et al. | |
| 5,388,741 | A * | 2/1995 | Hillinger | A45F 5/02 206/349 |
| 5,979,652 | A | 11/1999 | Rösler | |
| 6,854,594 | B2 * | 2/2005 | Vasudeva | B65D 73/0064 206/1.5 |
| 7,416,082 | B2 | 8/2008 | Rösier | |
| 7,624,865 | B2 | 12/2009 | Pendergraph et al. | |
| 8,336,710 | B2 | 12/2012 | Chang | |
| 2006/0201836 | A1 | 9/2006 | Pendergraph et al. | |
| 2007/0080086 | A1 | 4/2007 | Dreps | |
| 2007/0228240 | A1 | 10/2007 | Kao | |

FOREIGN PATENT DOCUMENTS

| | | |
|---|---|---|
| CN | 102658912 | 9/2012 |
| EP | 0693436 | 1/1996 |

* cited by examiner

*Primary Examiner* — Bryon Gehman
(74) *Attorney, Agent, or Firm* — Gerard Messina

(57) ABSTRACT

A hang tag includes a main body and a retaining portion. The main body includes a ridge that extends in a direction from a top of the main body to a bottom of the main body. The ridge divides the main body into a first region at a first side of the ridge and a second region at a second side of the ridge. The retaining portion includes (a) prongs configured to, when the portion of the object is inserted in the retaining portion, engage with side grooves in opposite sides of the object to prevent the object from rotating, and (b) ribs configured to support the prongs when the prongs are forced towards the ribs.

15 Claims, 12 Drawing Sheets

HANG TAG FOR DISPLAYING AN OBJECT

CROSS-REFERENCE TO RELATED APPLICATION

This application claims the benefit of U.S. Provisional Application No. 62/356,977, which was filed on Jun. 30, 2016, and which is hereby incorporated herein by reference in its entirety.

FIELD OF THE INVENTION

The present invention relates generally to product display packages, and more specifically to configurations of hang tags by which products can be hung on displays.

BACKGROUND

Product display packages are typically used to exhibit products, for example, in retail stores, and often in a manner designed to promote the products while also providing product and retail information. In addition, some product display packages may include security tags. However, there are some downsides to these conventional product display packages. For example, in the case of drill bits, there are some product display packages that are expensive to manufacture, wasteful in material, large to store, prone to damage, easy to remove, etc.

For example, a hang tag is an example product display package used for displaying a drill bit, but from which the drill bit is often easily removable. Unfortunately, some shoplifters take advantage of these types of product display packages by removing the drill bits from their product display packages in order to separate the drill bits from the security tags and steal the drill bits from the store. Also, if the product display packages are easy to remove, then some shoppers may swap the product tag of a more expensive drill bit with the product tag of a less expensive drill bit in order to pay less money for the more expensive drill bit. In each of these cases, there is a substantial amount of loss.

SUMMARY

The following is a summary of certain embodiments described in detail below. The described aspects are presented merely to provide the reader with a brief summary of these certain embodiments and the description of these aspects is not intended to limit the scope of this disclosure. Indeed, this disclosure may encompass a variety of aspects that may not be explicitly set forth below.

In an example embodiment, a hang tag includes a main body and a retaining portion. The main body includes a ridge that extends in a direction from a top of the main body to a bottom of the main body. The ridge divides the main body into a first region at a first side of the ridge and a second region at a second side of the ridge. The retaining portion includes (a) prongs configured to, when the portion of the object is inserted in the retaining portion, engage with side grooves in opposite sides of the object to prevent the object from rotating, and (b) ribs configured to support the prongs when the prongs are forced towards the ribs.

In an example embodiment, a hang tag includes a body portion, a retaining portion, and a protrusion. The body portion includes a ridge that divides the body portion into a first surface portion and a second surface portion. The retaining portion includes ribs that engage with opposite sides of an object to prevent rotation of the object. The protrusion extends from a vertex of the ridge of the body portion to a retaining portion. The protrusion is configured to hold the object within the retaining portion.

In an example embodiment, an apparatus includes a drill bit and a hang tag. The drill bit includes at least a first center groove and at least two side grooves. The hang tag includes a main body and a retaining portion. The main body includes a ridge that extends in a direction from a top of the main body to a bottom of the main body and that divides the main body into a first region at a first side of the ridge and a second region at a second side of the ridge. The retaining portion includes (a) prongs configured to, when the portion of the object is inserted in the retaining portion, engage with side grooves in opposite sides of the object to prevent the object from rotating, and (b) ribs configured to support the prongs when the prongs are forced towards the ribs.

These and other features, aspects, and advantages of the present invention are further clarified by the following detailed description of certain exemplary embodiments in view of the accompanying drawings throughout which like characters represent like parts.

DETAILED DESCRIPTION

The present disclosure relates to a product display package, particularly a hang tag, which is a display and suspension structure for an object. FIG. 1*a* shows an example hang tag 100 configured to receive an elongated object, such as a tool. In an example embodiment, the hang tag 100 is configured to receive, hold, and suspend a drill bit, such as that configured for an SDS type of a drill system. Also, other tools can be similarly received, held, and suspended by the hang tag 100 in other example embodiments.

Figure 1B:
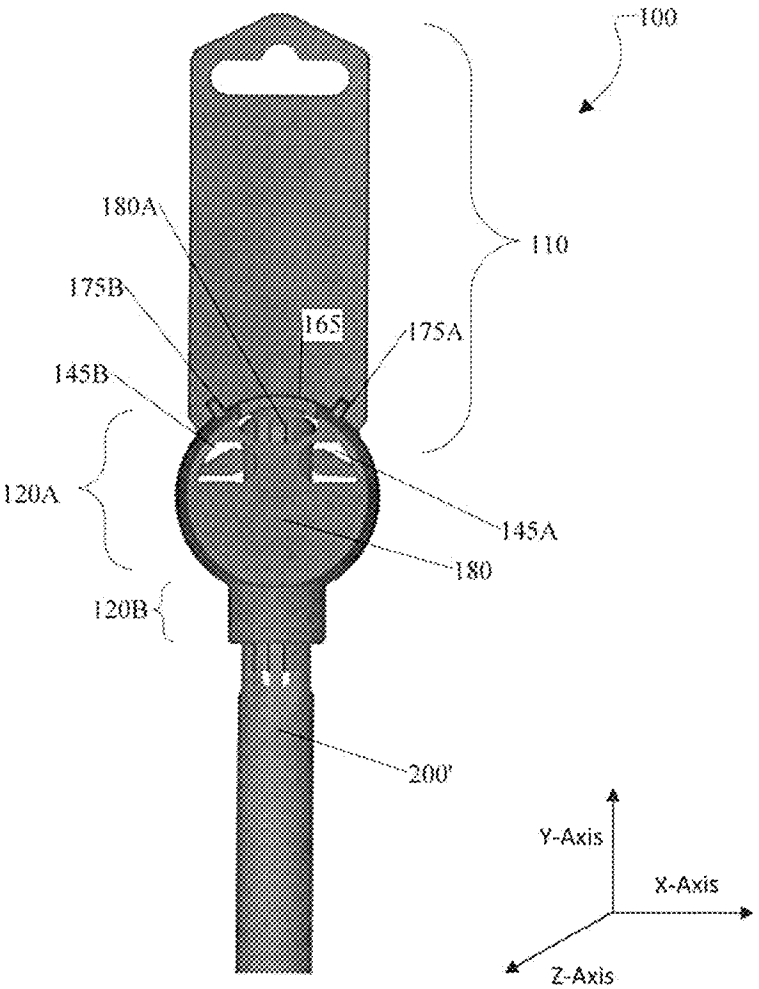
FIG. 1B is a rear view of the apparatus of FIG. 1A according to an example embodiment of the present invention.
Figure 1A:
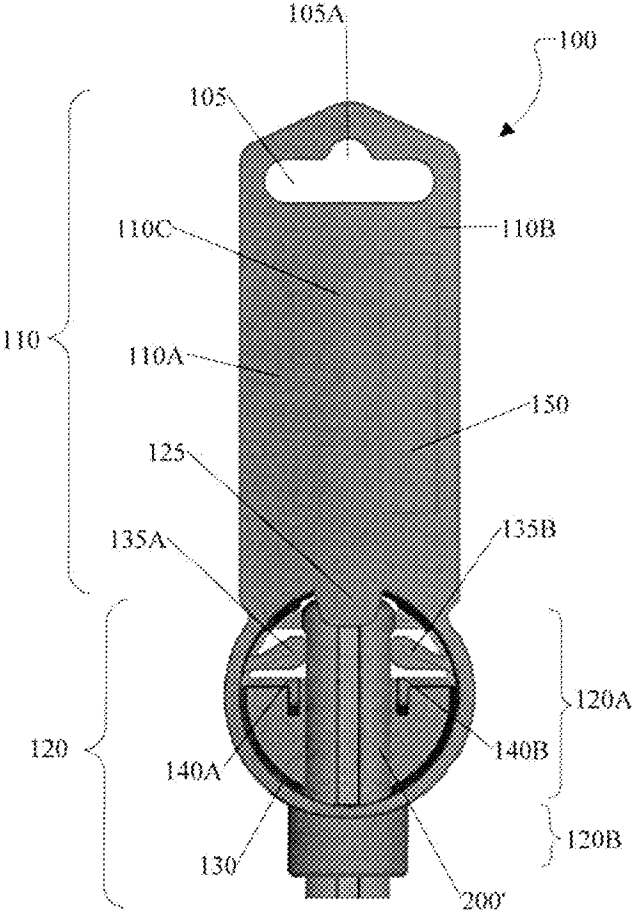
FIG. 1A is a front view of an apparatus according to an example embodiment of the present invention.

FIGS. 1A-1B are front and rear views of an example embodiment of an apparatus comprising a product display package and an object. More specifically, in this example, the product display package is a hang tag 100 while the object is an SDS-max drill bit 200' (i.e., a drill bit for an SDS-max drill system). FIGS. 4B, 6B, 7B, 8B, and 9B further illustrate this example embodiment of the hang tag 100, which is configured to accommodate an SDS-max drill bit 200'. However, the apparatus is not limited to this configuration of the hang tag 100 and this type of object, but can include other configurations of the hang tag 100 and other types of objects (e.g., a drill bit for an SDS-plus drill system), as discussed below.

Figure 2A:
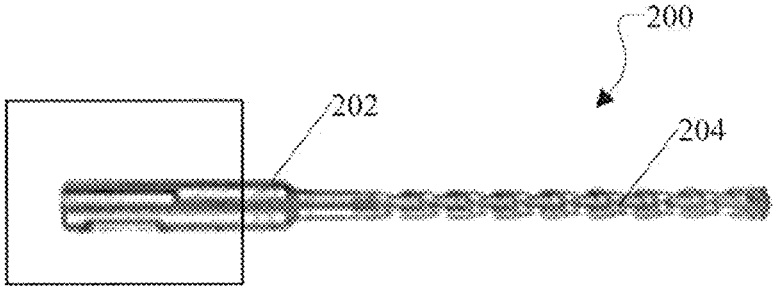
FIG. 2A is a perspective view of an example of a drill bit for an SDS-plus drill system.
Figure 2B:
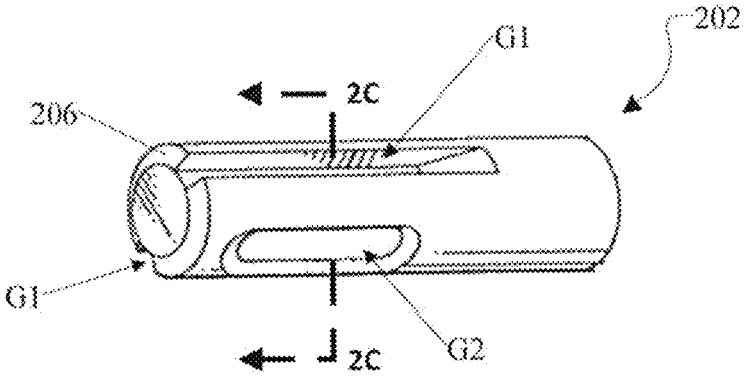
FIG. 2B is a perspective view of a shank of the drill bit shown in FIG. 2A.

FIGS. 2A-2B are perspective views of an example drill bit 200 for an SDS-plus drill system. As shown in FIG. 2A, the drill bit 200 includes a shank 202 at a first end portion and a drill body 204 at a second end portion. Meanwhile, FIG. 2B provides an enlarged perspective view of the boxed-in portion of the shank 200 of FIG. 2A. In the illustrated example, the shank 202 of the drill bit 200 for an SDS-plus drill system includes two open grooves G1 and two closed grooves G2 (only one of which can be seen in the perspective view of FIG. 2B). The open grooves G1 extend to and through an end face 206 of the first end portion of the drill bit 200 and are thus considered "open" at one end. As shown in FIG. 2B, an outer outline of the open grooves G1 is rectangular or substantially rectangular. In contrast, the closed grooves G2 are spaced apart from the end face 206 of the first end portion of the drill bit 200 and are thus considered "closed." As shown in FIG. 2B, an outer outline of the closed grooves G2 is elliptical or substantially elliptical in plan view.

Figure 2C:
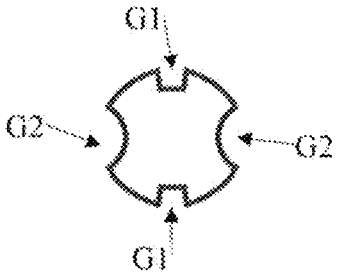
FIG. 2C is a cross-sectional view of the shank taken at line "2C-2C" of FIG. 2B.

FIG. 2C is a cross-sectional view of the shank 202 along line "2C-2C" of FIG. 2B, showing the cross-sectional configuration of the two open grooves G1 and the two closed grooves G2 of the shank 202 of the drill bit 200 for an SDS-plus drill system. The two open grooves G1 are disposed opposite to each other, and the two closed grooves G2 are disposed opposite to each other. This groove pattern on the shank 202 enables the drill bit 200 to be grasped and held by a chuck of the SDS-plus drill system.

Figure 3A:
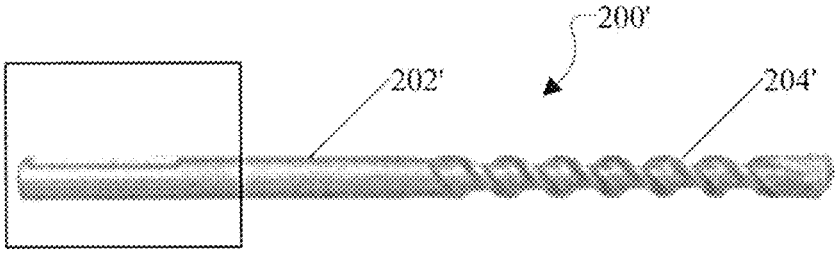
FIG. 3A is a perspective view of an example of a drill bit for an SDS-max drill system.
Figure 3B:
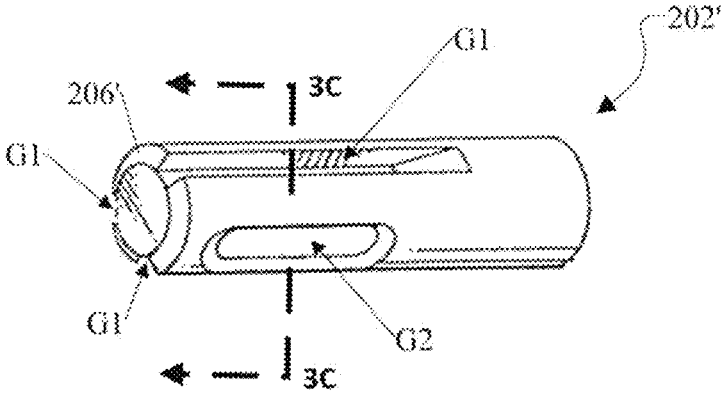
FIG. 3B is a perspective view of a shank of the drill bit shown in FIG. 3A.

FIGS. 3A-3B are perspective views of an example of a drill bit 200' for an SDS-max drill system. As shown in FIG. 3A, the drill bit 200' includes a shank 202' at a first end portion and a drill body 204' at a second end portion. Meanwhile, FIG. 3B is an enlarged perspective view of the boxed-in portion of the shank 202' of the drill bit 200' shown in FIG. 3A. In the illustrated example, the shank 202' of the drill bit 200' for an SDS-max drill system includes three open grooves G1 and two closed grooves G2 (only one of which can be seen in the perspective view of FIG. 3B). The open grooves G1 extend to and through an end face 206' of the first end portion of the drill bit 200' and are thus considered "open" at one end. As shown in FIG. 3B, an outer outline of the open grooves G1 is rectangular or substantially rectangular. In contrast, the closed grooves G2 are spaced apart from the end face 206' of the first end portion of the drill bit 200' and is thus considered "closed." As shown in FIG. 3B, an outer outline of the closed grooves G2 is elliptical or substantially elliptical in plan view.

Figure 3C:
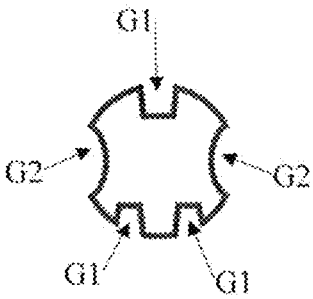
FIG. 3C is a cross-sectional view of the shank taken at line "3C-3C" of FIG. 3B.

FIG. 3C is a cross-sectional view of the shank 202' along line "3C-3C" of FIG. 3B, showing the cross-sectional configuration of the three open grooves G1 and the two closed grooves G2 of the shank 202' of the drill bit 200' for an SDS-max drill system. Unlike the groove pattern of the shank 202 of the drill bit 200 for an SDS-plus drill system, the groove pattern of the shank 202' of the drill bit 200' for an SDS-max drill system includes two open grooves G1 on one side of the drill bit 200' and one open groove G1 on an opposite side of the same drill bit 200'. However, similarly to the drill bit 200 for the SDS-plus drill system, the drill bit 200' for the SDS max system includes two closed grooves G2, which are positioned opposite to each other. This groove pattern on the shank 202' enables the drill bit 200' to be grasped and held by a chuck of the SDS-max drill system.

As discussed above, the hang tag 100 is configured to display a drill bit, such as one of the example drill bits 200/200' illustrated in FIGS. 2A-2C and 3A-3C, by suspending it with its longitudinal axis extending in a vertical direction. To provide proper support for such an object, the hang tag 100 comprises a suitable material with sufficient rigidity and strength to hold the object. As an example, the hang tag 100 comprises a rigid plastic material, such as a thermoplastic polymer. In an example embodiment, the hang tag 100 comprises acrylonitrile butadiene styrene (ABS). With such a material composition, the hang tag 100 is able to be manufactured with ease via a two-plate molding process.

Figure 4B:
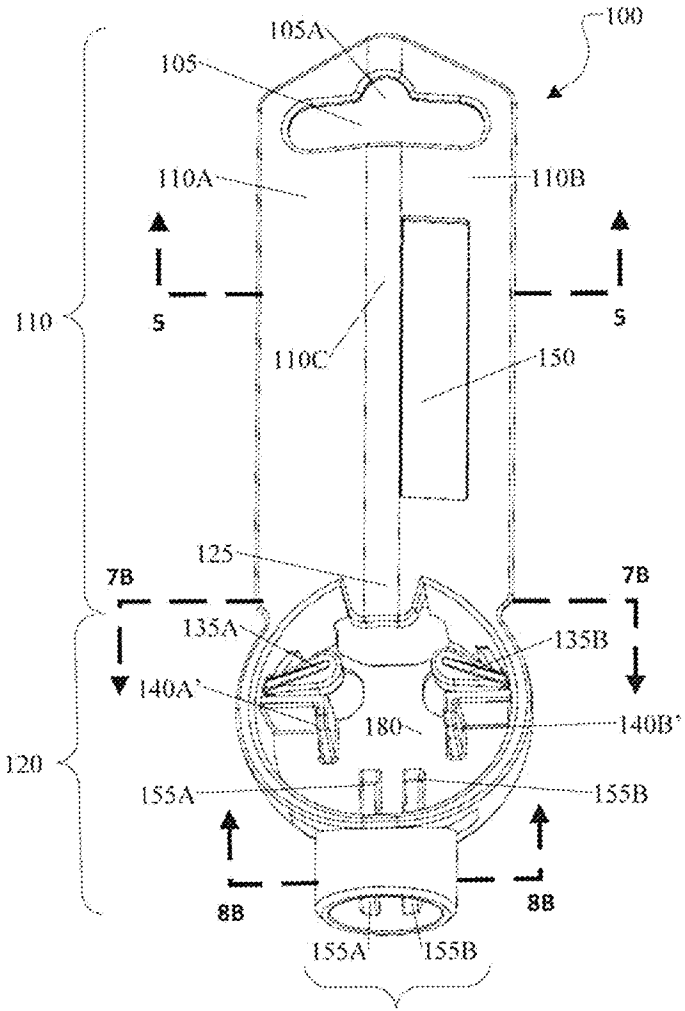
FIG. 4B is a front view of a hang tag configured to receive an SDS-max drill bit according to an example embodiment of the present invention.
Figure 4A:
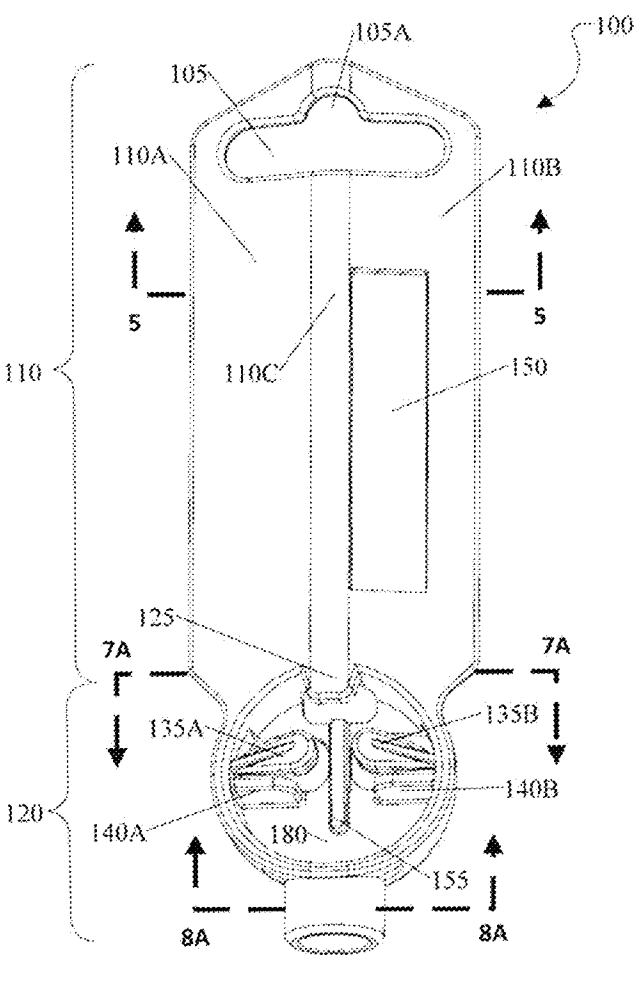
FIG. 4A is a front view of a hang tag configured to receive an SDS-plus drill bit according to an example embodiment of the present invention.

FIGS. 4A-4B and 11A-11B illustrate front views of example embodiments of the hang tag 100. More specifically, FIGS. 4A-4B illustrate example configurations of the hang tag 100 with the example embodiment of FIG. 4A being configured for the SDS-plus drill bit 200 and the example embodiment of FIG. 4B being configured for the SDS-max drill bit 200'. Meanwhile, 11A-11B illustrate other configurations of the hang tag 100 with the example embodiment of FIG. 11A being configured for the SDS-plus drill bit and the example embodiment of FIG. 11B being configured for the SDS-max drill bit 200'.

In each of these configurations of FIGS. 4A, 4B, 11A, and 11B, the hang tag 100 includes a body portion 110 and a retaining portion 120. In an example embodiment, the body portion 110 and the retaining portion 120 are integrally formed as a monolithic structure. In an example, the hang tag 100 is a monolithic structure comprising ABS. In an alternative embodiment, the hang tag 100 comprises a plurality of suitable parts (e.g., at least body portion 110 and retaining portion 120) which are joined or connected together to form a single structural unit. In this example, the plurality of suitable parts are the same material or different materials as long as the composition has suitable strength and rigidity.

In an example embodiment, the body portion 110 includes an upper portion of the hang tag 100 or a main body of the hang tag 100. In the illustrated examples, the body portion 110 itself is an elongated structure in which its length is greater than its width. As an example, the body portion 110 is elongated in the vertical direction (along the y-axis) in which the hang tag 100 is aligned by the force of gravity, when suspended from a component on which a mounting aperture 105 (discussed in more detail below) is hung, and which is parallel or substantially parallel to the longitudinal axis of the object, e.g., the drill bit 200/200' that the hang tag 100 is configured to hold.

An outline of the outer edge of the body portion 110, in plan view, can be of any suitable shape. For example, in an example embodiment, in plan view, the shape is polygonal or substantially polygonal. For instance, in the illustrated embodiments, the shape is substantially hexagonal (its hexagonal shape being interrupted by the retaining portion 120). Also, in an example embodiment, the shape of the outline of the body portion 110 is symmetrical or substantially symmetrical. For instance, as shown in FIGS. 1A-1B, the hang tag 100 (and hence the body portion 110) includes at least one axis of symmetry, which extends along the vertical or longitudinal direction (along the y-axis) of the hang tag 100.

In an example embodiment, the body portion 110 includes a ridge or ridge-like structure. The ridge or ridge-like structure includes a vertex 110C, which defines a first surface portion 110A and a second surface portion 110B, and which provides the body portion 110 of the hang tag 100 with enhanced rigidity and strength. The enhanced rigidity of the main body 110 is particularly beneficial in preventing the hang tag 100 from twisting, flexing, warping, or bending. The hang tag 100 is therefore less prone to damage, which may occur, for example, while boxing and shipping the hang tag 100 and the object received therein to their retail destination.

Figure 5:
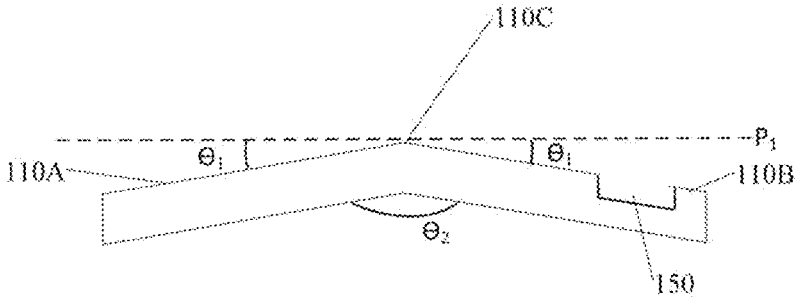
FIG. 5 is a cross-sectional view, taken at line "5-5" of any one of FIGS. 4A, 4B, 11A and 11B, according to an example embodiment of the present invention.

FIG. 5 shows a cross-section, taken along line "5-5" of any one of the example embodiments of FIGS. 4A, 4B, 11A, and 11B. As shown in FIG. 5, each of the first surface portion 110A and the second surface portion 110B extends away from a plane $P_1$, defined by a tangent of the vertex 110C that is perpendicular to the longitudinal axis of the hang tag 100, at an acute angle $\theta_1$. With these acute angles, the body portion 110 is provided with a first angled surface including the first surface portion 110A and the second surface portion 110B. Also, as shown in FIG. 5, the body portion 110 is provided with a second angled surface at a side of the body portion 110 opposite to the first angled surface, the second angled surface forming an obtuse angle $\theta_2$. As mentioned earlier, the angling of the body portion 110 provides the hang tag 100 with the added benefit of a rigid structure. According to an alternative example embodiment, the surface opposite the first angled surface is not angled in the manner described, but is rather, for example, flat, providing the body portion 110 with a triangular cross-section, or, for example, the surface opposite the first angled surface can be angled to protrude in the mirror image of the first angled surface.

In addition, the angling of the first angled surface of the body portion 110 advantageously provides a wider view angle of a label region, where a label can be applied, compared to that of a flat body portion. The label itself can include relevant information about the object held by the hang tag 100. For example, the label can include information such as that relating to the product, the retailer, the manufacturer, other types of sales information, or any combination thereof. In an example embodiment, the label region comprises a front side of the first surface portion 110A, a front side of the second surface portion 110B, or front sides of both the first and second surface portions 110A and 110B. In another example embodiment, the label region comprises both front and rear sides of the first surface portion 110A, front and rear sides of the second surface portion 110B, or both the front and rear sides of the first and second surface portions 110A and 110B.

In an example embodiment, the body portion 110 includes a recess portion 150 in which a security device/tag can be disposed. As shown in each of the example embodiments of FIGS. 4A, 4B, 11A, and 11B, the recess portion 150 is configured to extend in a longitudinal direction on one side of the ridge 110C, with the recess portion 150 being disposed in its entirety in the second surface portion 110B of the hang tag 100. In an alternative example embodiment, the recess portion 150 is disposed in its entirety in the first surface portion 110A of the hang tag 100. In this example embodiment, the recess portion 150 does not overlap the vertex 110C of the ridge, but remains on a single surface portion (e.g., only the second surface portion 110B) of the hang tag 100. The positioning of the recess portion 150 ensures that a security device, which is positioned therein, experiences less disruption in the event that the hang tag 100 is, for example, flexed in at least the horizontal direction (along the x-axis).

In an example embodiment, the recess portion 150 is configured to receive a security sensor, a security tag, or any suitable security device, which is traceable and/or deters theft. As a non-limiting example, the security tag is a Sensormatic® tag. In this regard, the recess portion 150 is sized such that an appropriate security device is able to be held therein. Additionally or alternatively, in an example embodiment, a depth of the recess portion 150 is such that the security device is substantially flush or below a surface of the body portion 110. By providing a recess portion 150 in this manner, i.e., such that the security device does not protrude from the surface of the body portion 110, the hang tag 100 is able to advantageously include a security device that is concealed from an individual's view (e.g., a shopper's view) when a label is placed in the label region and overlays the recess portion 150. In such a scenario, the concealment of the security device is advantageous, as it prevents the security device from being removed from the hang tag 100.

In an example embodiment, the body portion 110 includes a mounting aperture 105. The mounting aperture 105 is a through-hole, which is configured to receive an element, such as a display rod or hook, from which the hang tag 100 can be hung. In an example embodiment, the mounting aperture 105 is positioned at an upper portion of the body portion 110. For example, as shown in FIG. 1A, the mounting aperture 105 is disposed proximate to the uppermost angle of the hexagonal shape that forms the body portion 110.

In an example embodiment, the mounting aperture 105 is disposed at or proximate to the axis of symmetry of the hang tag 100. For example, in an example embodiment, the mounting aperture 105 is horizontally centered or substantially horizontally centered on the hang tag 100. In an example embodiment, the mounting aperture 105 is located at a position of the body portion 110 such that the hang tag 100 is self-centered and upright when hung or mounted on a display rod or hook, the hang tag 100 being upright when its central longitudinal axis is vertical to the ground, with the body portion 110 being above the retaining portion 120.

In an example embodiment, the shape of the mounting aperture 105 enables the hang tag 100 to self-center in an upright manner when in a hanging state. In this regard, for example, the shape of the mounting aperture 105, shown in each of FIGS. 4A, 4B, 11A and 11B, includes a hanging notch 105A proximate to an upper end of the body portion 110 and on the vertex 110C, which is on the longitudinal axis of the hang tag 100. The shape of mounting aperture 105 can alternatively be any other suitable shape that enables the hang tag 100 to be hung in an upright manner. As another example, the mounting aperture 105 includes a triangular shape.

In an example embodiment, the body portion 110 is connected to the retaining portion 120. In an example embodiment, the retaining portion 120 is substantially located below the body portion 110 when the hang tag 100 is in its hanging state. In an example embodiment, an upper section of the retaining portion 120 overlaps a lower region of the body portion 110, and extends downward away from the lower region of the body portion 110. Additionally, in each of the illustrated embodiments, a bottom edge of the body portion 110 is also an upper edge of the retaining portion 120.

In an example embodiment, the retaining portion 120 includes at least a first cylindrical portion 120A and a second cylindrical portion 120B in which the longitudinal axis of the first cylindrical portion 120A is perpendicular to the longitudinal axis of the second cylindrical portion 120B. Each of the first and second cylindrical portions 120A and 120B is hollow and configured to receive different sections of an object (with the longitudinal axis of the second cylindrical portion 120B coinciding with a longitudinal axis of the received object). For example, the first cylindrical portion 120A is configured to hold an upper portion of a shank 202/202' of a drill bit 200/200' while the second cylindrical portion 120B is configured to hold a lower portion of the shank 202/202' of the drill bit 200/200'.

Figure 15:
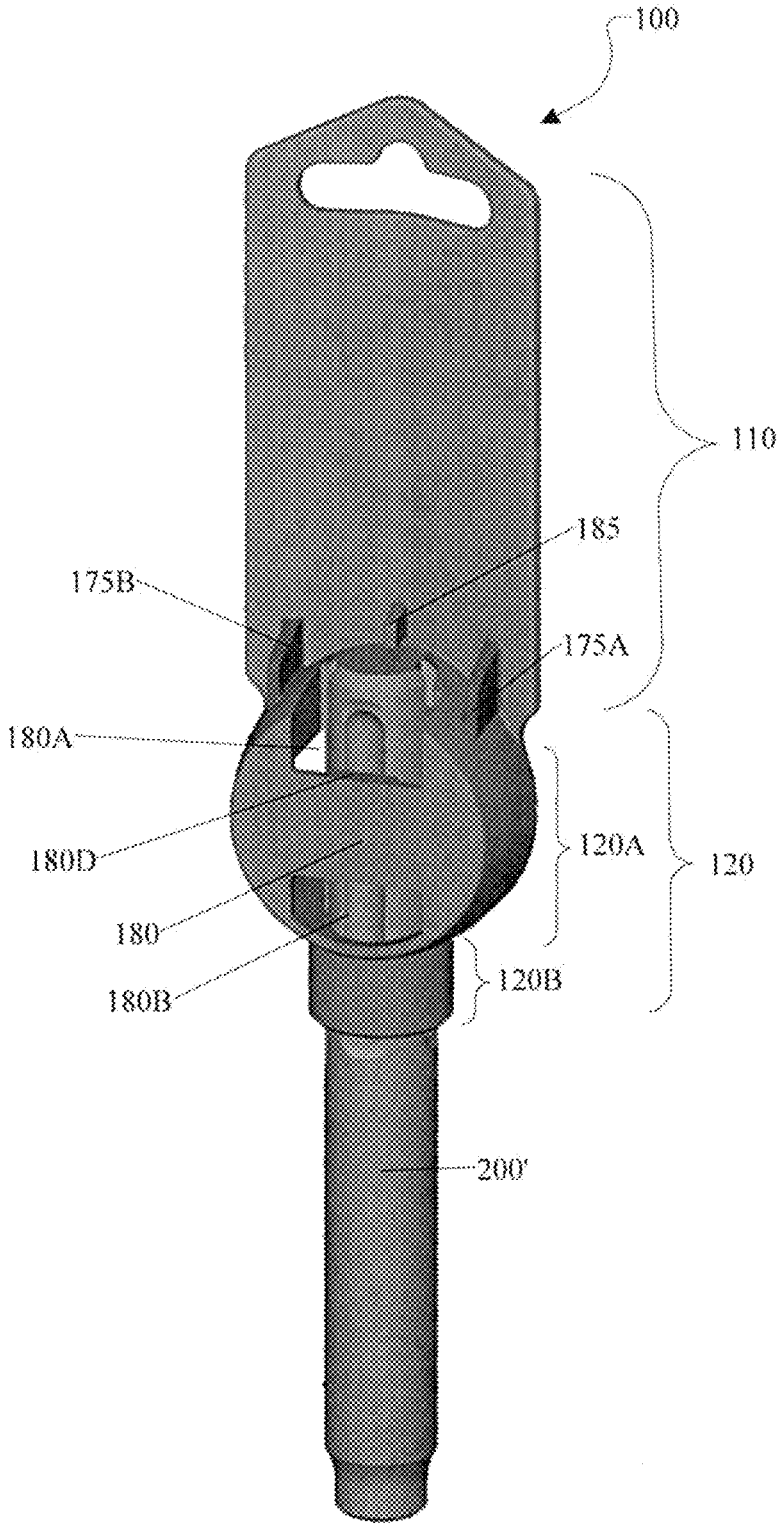
FIG. 15 is a rear view of an apparatus with an SDS-max drill bit according to an example embodiment of the present invention.

In an example embodiment, the first cylindrical portion 120A includes a supporting member 180, as shown in each of FIGS. 1A, 1B 4A, 4B, 9A, 9B, 11A, 11B, and 15. The supporting member 180 is configured to support the object when positioned within the hang tag 100. In an example embodiment, the supporting member 180 includes a first opening 180A, as shown in each of FIGS. 9A-9B and 15. In an example embodiment, the supporting member 180 further includes a second opening 180B, as shown in FIG. 15. Each of the first and second openings 180A and 180B is a through-hole, which enables inspection of the object when positioned within the hang tag 100. This feature is particularly beneficial in enabling individuals to verify and inspect the upper rear side of the object, e.g., a drill bit 200/200', in order to identify the product and confirm that the product matches the product label, for example by its groove pattern, which, in many cases differs in the upper portion of different drill bits, as discussed with respect to FIGS. 2A-2C and FIGS. 3A-3C.

Figure 6A:
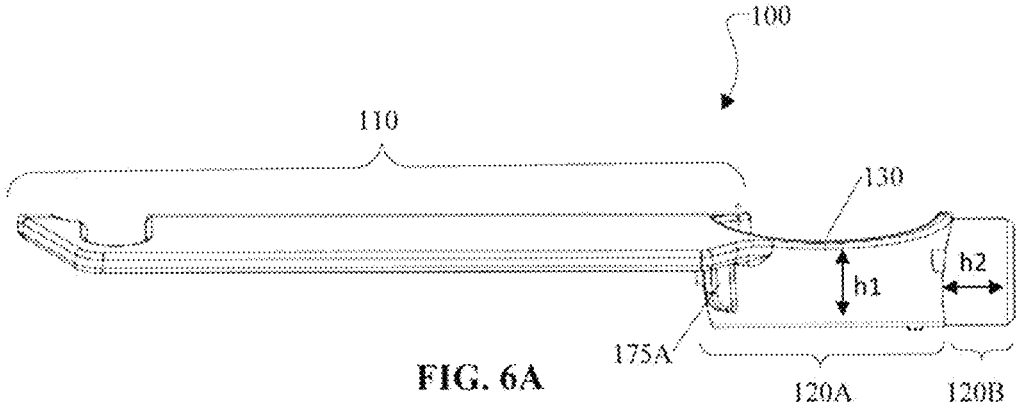
FIG. 6A is a side view of the hang tag of FIG. 4A according to an example embodiment of the present invention.
Figure 6B:
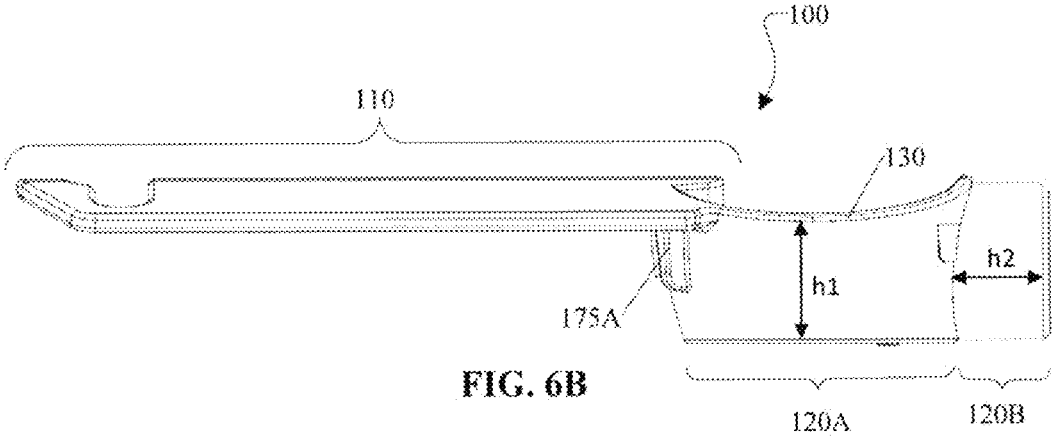
FIG. 6B is a side view of the hang tag of FIG. 4B according to an example embodiment of the present invention.

FIGS. 6A-6B are side views of the example embodiments of FIGS. 4A-4B, respectively. Meanwhile, FIGS. 12A and 12B are side views of the example embodiments of FIGS. 11A and 11B, respectively. As shown in each of the illustrated embodiments, the first cylindrical portion 120A is oriented such that its height h1 extends in a first direction along the z-axis corresponding to a direction of the thickness of the hang tag 100, which is perpendicular to the central longitudinal axis (the y-axis) of the hang tag 100. In contrast, the second cylindrical portion 120B is oriented such that its height h2 extends in a direction that is parallel to the central longitudinal axis (along the y-axis) of the hang tag 100. In other words, the first cylindrical portion 120A and the second cylindrical portion 120B are oriented differently such that their heights (h1 and h2) are perpendicular to each other.

Each of the first and second cylindrical portions 120A and 120B is hollow such that an object is enabled to be received therein. More specifically, as shown in each of FIGS. 6A, 6B, 12A, and 12B, when received by the retaining portion 120, the drill bit 200/200' extends such that its longitudinal axis is perpendicular to the height h1 of the first cylindrical portion 120A and parallel to the height h2 of the second cylindrical portion 120B. In an example embodiment, a diameter of the first cylindrical portion 120A is greater than a diameter of the second cylindrical portion 120B. The difference in diameters and orientations of the first and second cylindrical portions 120A and 120B is beneficial in that the larger diameter of the first cylindrical portion 120A provides greater visibility and inspection of the shank of the drill bit 200/200' while the smaller diameter of the second cylindrical portion 120B provides a secure hold of a section of the shank of the drill bit 200/200'.

First Set of Configurations of the Retaining Portion

FIGS. 1A and 4A-4B illustrate front views of first configurations of the retaining portion 120 according to example embodiments. More specifically, FIG. 4A illustrates an example embodiment of the retaining portion 120, which is configured to receive an SDS-plus drill bit 200. According to the example embodiment shown in FIG. 4A, the retaining portion 120 includes at least a first prong 135A, a second prong 135B, a first rib 140A, a second rib 140B, a guide 155, and a protrusion 125. FIG. 4B, on the other hand, illustrates an example embodiment of the retaining portion 120, which is configured to receive an SDS-max drill bit 200'. According to the example embodiment shown in FIG. 4B, the retaining portion 120 includes at least the first prong 135A, the second prong 135B, the first rib 140A', the second rib 140B', a first guide member 155A, a second guide member 155B, a protrusion 125, and a rail 190 (shown in FIG. 8B).

In an example embodiment, the first prong 135A includes a rib portion and a round portion. In an example embodiment, the rib portion provides structural support and strength to the round portion. In an example embodiment, the round portion is sized to fit within one of the closed grooves G2 of the drill bit 200/200'. As shown in each of FIGS. 4A and 4B, the rib portion of the first prong 135A is surrounded by the round portion of the first prong 135A when viewed as projected onto a single plane. In an example embodiment, the first prong 135A is flexible and configured to engage with one of the closed grooves G2 of the drill bit 200/200'.

In an example embodiment, the second prong 135B is positioned opposite to that of the first prong 135A, as shown in each of FIGS. 4A-4B. More specifically, in an example embodiment, the second prong 135B includes a rib portion and a round portion. In an example embodiment, the rib portion provides structural support and strength to the round portion. In an example embodiment, the round portion is sized to fit within one of the closed grooves G2 of the drill bit 200/200'. As shown in each of FIGS. 4A and 4B, the rib portion of the second prong 135B is surrounded by the round portion of the second prong 135B when viewed as projected onto a single plane. In an example embodiment, the second prong 135B is flexible and configured to engage with an opposite one of the closed grooves G2 of the drill bit 200/200'.

In an example embodiment, each of the first prong 135A and the second prong 135B is configured to flex within the retaining portion 120. More specifically, the first prong 135A and the second prong 135B are configured to deflect away from the lower portion of the first cylindrical portion 120A when the object (e.g., the drill bit 200/200') is inserted into the hang tag 100. Also, in an example embodiment, the first prong 135A and the second prong 135B are configured to engage and abut against walls defining the closed grooves G2 of the shank of the drill bit 200/200' when the drill bit 200/00' is forcibly pulled downwards along the longitudinal direction, for example, during an attempt to remove the drill bit 200/200' from the hang tag 100. Advantageously, this engagement and abutment helps prevent the drill bit 200/200' from being removed from the hang tag 100.

In an example embodiment, the first rib 140A/140A' is configured to provide structural support to the first prong 135A when a downward force is applied to the first prong 135A. More specifically, the first rib 140A/140A' includes an abutment surface, which is configured to prevent the first prong 135A from extending beyond the abutment surface and/or breaking when, for example, the object is pulled in a downward direction. For example, as shown in FIG. 4A, when configured for an SDS-plus drill bit 200, the first rib 140A includes an abutment surface, which extends parallel to the X-axis and faces a bottom part of the first prong 135A. Alternatively, as shown in FIG. 4B, when configured for an SDS-max drill bit 200', the first rib 140A' is substantially L-shaped with (i) an abutment surface extending parallel to the X-axis and facing the bottom part of the first prong 135A and (ii) a support surface extending parallel to the Y-axis and facing the object (when inserted in the hang tag 100). In addition, as shown in each of FIGS. 4A-4B, the first rib 140A/140A' is spaced from the first prong 135A to enable the first prong 135A to flex to a certain extent before contacting the abutment surface of the first rib 140A/140A'.

In an example embodiment, the second rib 140B/140B' is configured to provide structural support to the second prong 135B when a downward force is applied to the second prong 135B. More specifically, the second rib 140B/140B' includes an abutment surface, which is configured to prevent the second prong 135B from extending beyond the abutment surface and/or breaking when, for example, the object is pulled in a downward direction. For example, as shown in FIG. 4A, when configured for an SDS-plus drill bit 200, the second rib 140B includes an abutment surface, which extends parallel to the X-axis and faces a bottom part of the second prong 135B. Alternatively, as shown in FIG. 4B, when configured for an SDS-max drill bit 200', the second rib 140B' is substantially L-shaped with (i) an abutment surface extending parallel to the X-axis and facing the bottom part of the second prong 135B and (ii) a support surface extending parallel to the Y-axis and facing the object (when inserted in the hang tag 100). In addition, as shown in each of FIGS. 4A-4B, the second rib 140B/140B' is spaced from the second prong 135B to enable the second prong 135B to flex to a certain extent before contacting the abutment surface of the first rib 140A/140A'.

In an example embodiment, the protrusion 125 extends from a bottom edge of the body portion 110 on the longitudinal axis of the hang tag 100 and into the first cylindrical portion 120A. In an example embodiment, the protrusion 125 is configured to extend over the open groove G1 of the shank of the drill bit 200/200'. In this regard, the protrusion 125 is wider than the open groove G1 of the shank of the drill bit 200/200'. In an example embodiment, the protrusion 125 is configured to provide an additional protection against a tilting of the drill bit 200/200' by which a top of the shank of the drill bit 200/200' is shifted in a direction of height h1, away from the supporting member 180 and towards the protrusion 125.

In an example embodiment, the guide 155 is positioned on a front surface of the supporting member 180. In an example embodiment, the guide 155 extends parallel to the longitudinal axis (y-axis). In an example embodiment, the guide 155 is configured to align the drill bit 200/200' within the hang tag 100 such that the first and second prongs 135A and 135B fully engage the closed grooves G2 of the drill bit 200/200'. In addition, the guide 155 is configured to prevent the drill bit 200/200' from rotating when inserted in the hang tag 100. A more detailed discussion of the guide 155 is discussed together with FIGS. 7A-7B.

Figure 7A:
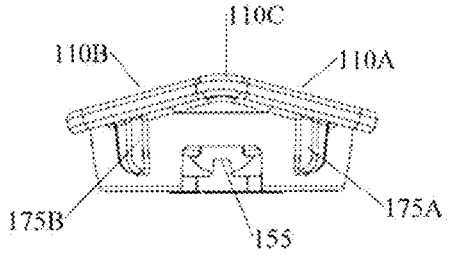
FIG. 7A is a cross-sectional view, taken at line "7A-7A" of FIG. 4A, according to an example embodiment of the present invention.
Figure 7B:
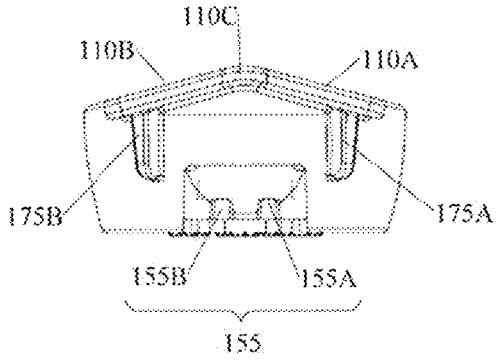
FIG. 7B is a cross-sectional view, taken at line "7B-7B" of FIG. 4B, according to an example embodiment of the present invention.

FIGS. 7A-7B are cross-sectional views, taken at lines "7A-7A" and "7B-7B" of the example embodiments of FIGS. 4A-4B, respectively. More specifically, FIGS. 7A-7B illustrate the guide 155 in relation to the vertex 110C and supporting structures 175A and 175B (discussed in detail below with respect to FIGS. 9A-9B). As shown, the guide 155 is located in a region, which is between the supporting structures 175A and 175B and which is horizontally centered about the hang tag 100.

FIG. 7A illustrates a cross-section of an upper part of the retaining portion 120, which is configured for an SDS-plus drill bit 200. As shown in FIG. 7A (and also in FIG. 8A), the guide 155 is located on a surface of the retaining portion 120. In an example embodiment, the guide 155 is configured to engage with the open groove G1 of an SDS-plus drill bit 200 (FIGS. 2A-2C). In an example embodiment, the guide 155 is positioned in a space between the first prong 135A and the second prong 135B. Also, in an example embodiment, the guide is positioned within the first cylindrical portion 120A while being spaced from the second cylindrical portion 120B (FIG. 4A). In this regard, the guide 155 is configured to hold the drill bit 200 and prevent the drill bit 200 from rotating within the hang tag 100.

FIG. 7B illustrates a cross-section of an upper part of the retaining portion 120, which is configured for an SDS-max drill bit 200'. As shown in FIG. 7B (and also in FIG. 8B), the guide 155 is located on a surface of the retaining portion 120. In an example embodiment, the guide 155 includes a first guide member 155A and a second guide member 155B.

In an example embodiment, the first and second guide members 155A and 155B are configured to engage with two of the three open grooves G1 of the SDS-max drill bit 200' (FIG. 3A-3C). In an example embodiment, the first and second guide members 155A and 155B extend from the first cylindrical portion 120A and into the second cylindrical portion 120B (FIG. 4B). In this regard, the first and second guide members 155A and 155B are configured to hold the drill bit 200' and prevent the drill bit 200' from rotating within the hang tag 100.

Figure 8A:
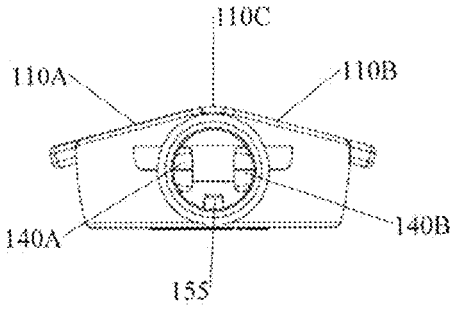
FIG. 8A is a cross-sectional view, taken at line "8A-8A" of FIG. 4A, according to an example embodiment of the present invention.
Figure 8B:
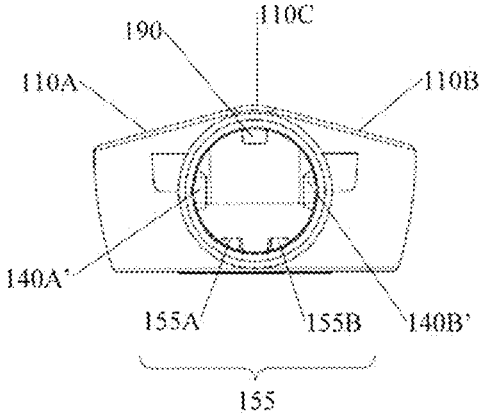
FIG. 8B is a cross-sectional view, taken at line "8B-8B" of FIG. 4B, according to an example embodiment of the present invention.

FIGS. 8A-8B are cross-sectional views, taken at line "8A-8A" and "8B-8B" of FIGS. 4A-4B, respectively. More specifically, FIGS. 8A-8B illustrate cross-sections of the second cylindrical portion 120B according to example embodiments. For instance, in an example embodiment, as shown in FIG. 8A, the second cylindrical portion 120B includes a relatively smooth interior surface that enables an object to be easily inserted therein. Alternatively, in another example embodiment, as shown in FIG. 8B, the second cylindrical portion 120B includes an interior surface with at least one rail 190 that is aligned with a longitudinal axis of the hang tag 100.

In an example embodiment, the rail 190 is structured to fit within an open groove G1 of a shank of a drill bit 200/200'. More specifically, in an example embodiment, the rail 190 includes a rectangular or substantially rectangular profile to correspond to that of the open groove G1. In an example embodiment, the rail 190 extends along a height or longitudinal axis (i.e., y-axis) of an interior surface of the second cylindrical portion 120B. Also, the rail 190 is structured such that the drill bit 200/200', via its pattern of open grooves G1, is properly aligned and positioned in the hang tag 100. In addition, when the rail 190 is fitted into an open groove G1 of the shank of the drill bit 200/200', the rail 190 is structured to prevent a rotation of the drill bit 200/200'.

Figure 9B:
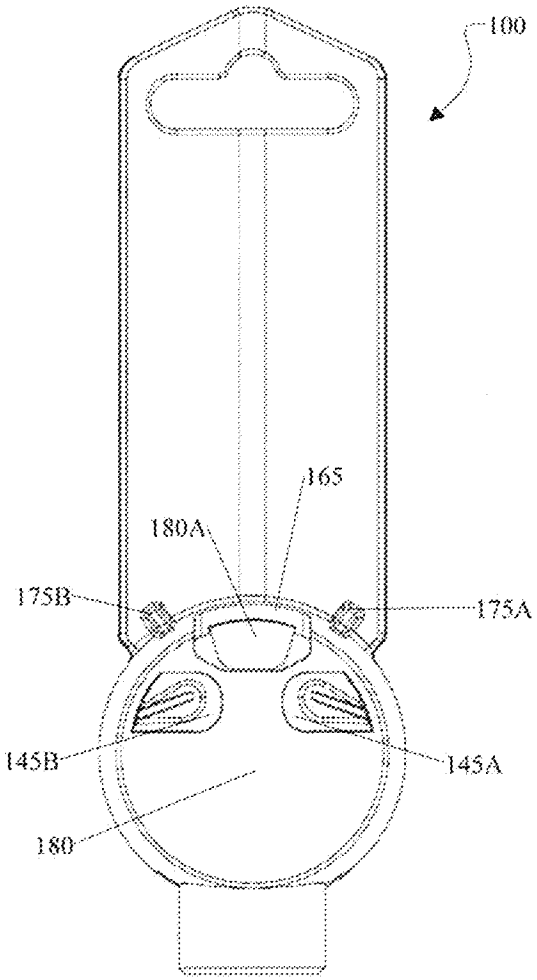
FIG. 9B is a rear view of the hang tag of FIG. 4B according to an example embodiment of the present invention.
Figure 9A:
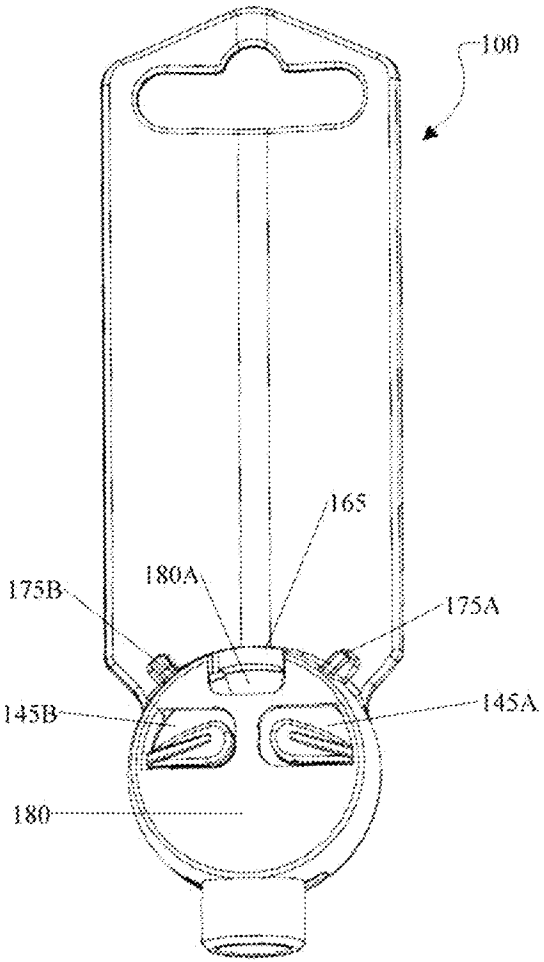
FIG. 9A is a rear view of the hang tag of FIG. 4A according to an example embodiment of the present invention.

FIGS. 9A-9B are rear views of the example embodiments of FIGS. 4A-4B. From these rear views, several features of the hang tag 100 are visible. For example, as shown in each of FIGS. 9A-9B, the rear side of the body portion 110 of the hang tag 100 includes supporting structures 175A and 175B, e.g., connecting to, with respect to the Y direction, an upper side of the first cylindrical portion 120A. The supporting structures 175A and 175B provide extra support for the first surface portion 110A and the second surface portion 110B. The supporting structures 175A and 175B enhance the strength, durability, and connection of the body portion 110 and the first cylindrical portion 120A.

In an example embodiment, the retaining portion 120 includes a rim portion 165. In an example embodiment, the rim portion 165 is a part of the sidewall of the first cylindrical portion 120A. More specifically, the rim portion 165 is configured to prevent an object, such as drill bit 200/200', from moving beyond the position of the rim portion 165 in the vertical or longitudinal direction (parallel to the y axis). In this regard, for example, the rim portion 165 is structured to provide an abutment surface for a top portion of the drill bit 200/200', thereby preventing a continued longitudinal motion of the drill bit 200/200' towards a top of the hang tag 110.

In an example embodiment, as shown in each of FIGS. 9A-9B, the supporting member 180 includes through holes 145A and 145B, which are located at positions corresponding to the positions of the first and second prongs 135A and 135B, respectively. In an example embodiment, the through holes 145A and 145B are formed so that the hang tag 100 can be removed from the molds with relative ease during the manufacturing/fabrication process of the hang tag 100. The through-holes 145A and 145B also enable corresponding sections of the shank of the drill bit 200/200' to be viewable when inserted in the hang tag 100.

Although FIGS. 4A-9B illustrate the hang tag 100 with the advantageous structural features discussed above, the hang tag 100 is not limited to the retaining portion 120 of the first set of configurations. In this regard, a second set of configurations is described below with reference to FIGS. 10-15.

Second Set of Configurations of the Retaining Portion

Figure 10:
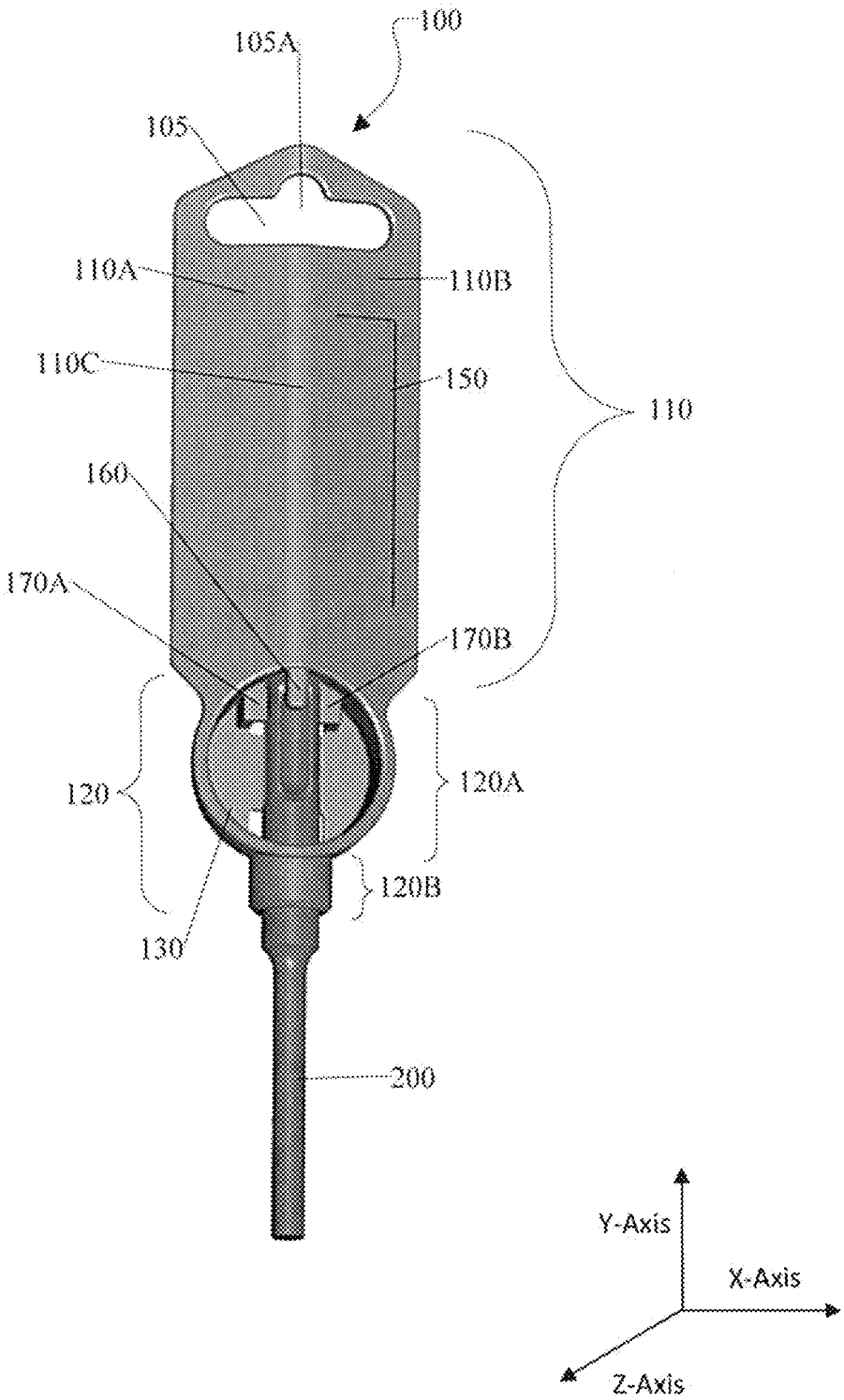
FIG. 10 is a front view of an apparatus with an SDS-plus drill bit according to an alternative example embodiment of the present invention.
Figure 11B:
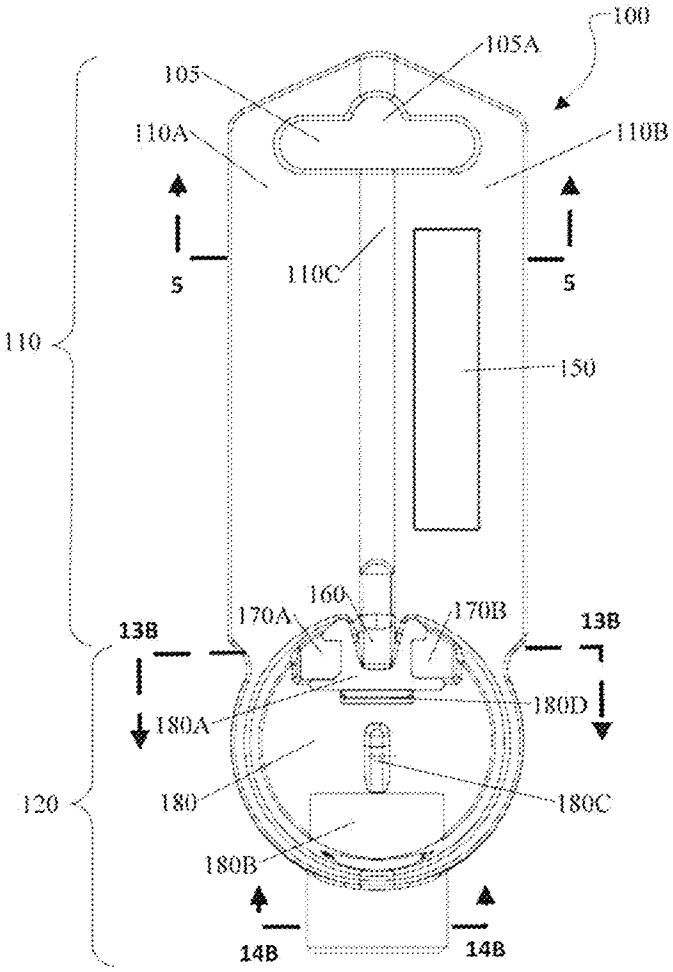
FIG. 11B is a front view of a hang tag configured to receive an SDS-max drill bit according to an alternative example embodiment of the present invention.
Figure 11A:
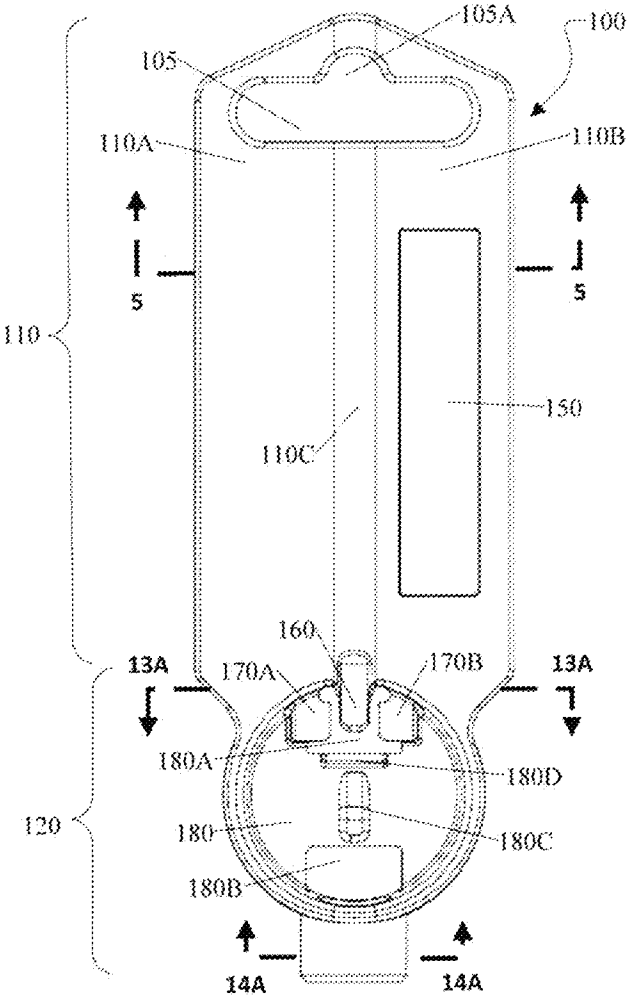
FIG. 11A is a front view of a hang tag configured to receive an SDS-plus drill bit according to an alternative example embodiment of the present invention.
Figure 12A:
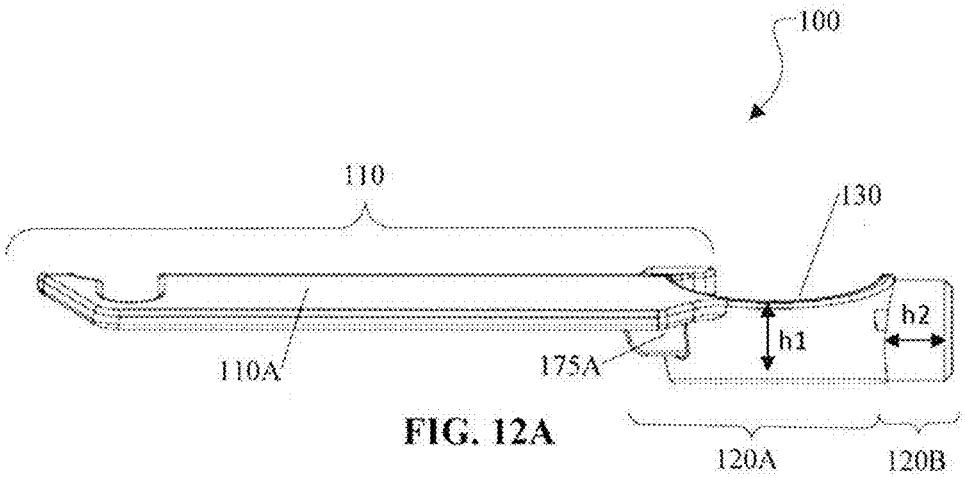
FIG. 12A is a side view of the hang tag of FIG. 11A according to an example embodiment of the present invention.
Figure 12B:
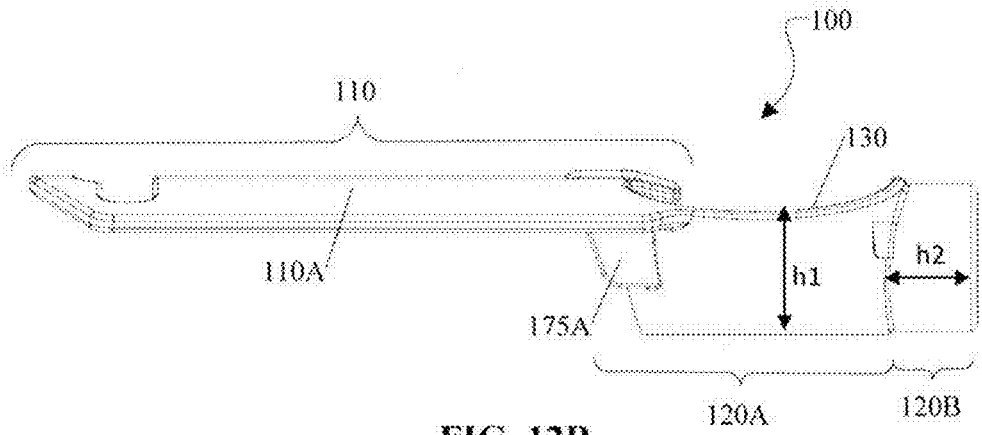
FIG. 12B is a side view of the hang tag of FIG. 11B according to an example embodiment of the present invention.

FIGS. 10 and 11A-11B illustrate front views of second configurations of the retaining portion according to example embodiments. More specifically, each of FIGS. 10 and 11A illustrates an example embodiment of the retaining portion 120, which is configured to receive an SDS-plus drill bit 200. According to the example embodiment shown in each of FIGS. 10 and 11A, the retaining portion 120 includes at least a first rib 170A, a second rib 170B, a protrusion 160, a guide 180C, and a projection 180D. FIG. 11B, on the other hand, illustrates an example embodiment of the retaining portion 120, which is configured to receive an SDS-max drill bit 200'. According to the example embodiment shown in FIG. 11B, the retaining portion 120 includes the first rib 170A, the second rib 170B, the protrusion 160, the guide 180C, the projection 180D, and rails 190 (the latter illustrated in FIG. 14B).

In an example embodiment, the ribs 170A and 170B extend downward in a direction of the Y-axis and away from an interior surface of the first cylindrical portion 120A. In an example embodiment, each of the ribs 170A and 170B additionally includes a suspended portion that extends horizontally parallel to the X-axis and that is configured to engage with a respective one of the open grooves G1 of the shank 202/202' of the drill bit 200/200'. In this regard, the suspended portion of each of the ribs 170A and 170B includes a substantially rectangular profile to fit within a respective open groove G1 of the shank 202/202' of the drill bit 200/200'. In addition, each of the ribs 170A and 170B is positioned within the first cylindrical portion 120A to correspond to positions of the open grooves G1 of the shank 202/202' of the drill bit 200/200', as discussed below with respect to FIGS. 13A-13B.

In an example embodiment, the protrusion 160 is aligned with the longitudinal axis of the hang tag 100 and extends from a bottom edge of the body portion 110 into the first cylindrical portion 120A. In an example embodiment, the protrusion 160 includes a knob or hook-like part at an end thereof that extends parallel to the longitudinal axis of the first cylindrical portion 120A (along the z-axis). The knob or hook-like part of the protrusion 160 is configured to provide a secure hold on an object upon being properly inserted into the hang tag 100. For example, in the example embodiment shown in the figures, the object is a drill bit 200/200' and the knob or hook-like part of the protrusion 160 is configured to engage with one of the closed grooves G2 of the drill bit 200/200', thereby constraining movements of the drill bit 200/200' along the Y-axis, relative to the hang tag 100, to a length of the groove G2 (less the space of groove G2 taken up by the knob or hook-like part of the protrusion 160), and preventing a rotational movement of the drill bit 200/200' relative to the hang tag 100.

In an example embodiment, the guide 180C is positioned on a front surface of the supporting member 180. In an example embodiment, the guide 180C includes a tapered region, a ramp, or a ramp-like profile. As shown in each of FIGS. 11A and 11B, the guide 180C is structured to assist an object, such as the drill bit 200/200', in achieving proper alignment within the hang tag 100, for example, by mating with one of the closed grooves G2 of the drill bit 200/200' when the drill bit 200/200' is inserted into the bottom of the second cylindrical portion 120B, thereby guiding the opposite closed groove G2 to the protrusion 160 and guiding the open grooves G1 to the ribs 170A and 170B. In addition, the guide 180C is configured to prevent the drill bit 200/200' from rotating when inserted in the hang tag 100.

In an example embodiment, the projection 180D is positioned on the front surface of the supporting member 180. In an example embodiment, the projection 180D is adjacent or near the first opening 180A, as shown in each of FIGS. 11A and 11B. In an example embodiment, the projection 180D positions the drill bit 200/200' such that the protrusion 160 properly and securely engages with the closed groove G2 of the drill bit 200/200'. In an example embodiment, the projection 180D is structured to extend across the face of, and outside, the closed groove G2. In this regard, for example, the projection 180D on the supporting member 180 accounts for the depth of the closed groove G2 receiving the protrusion 160 and enables the protrusion 160 to firmly abut against a bottom groove surface of the closed groove G2 of the drill bit 200/200' when the opposite side of the drill bit 200/200' lies against the projection 180D. This feature advantageously prevents the drill bit 200/200' from being easily removed from the hang tag 100, and therefore prevents, for example, losses associated with shoplifting.

Figure 13A:
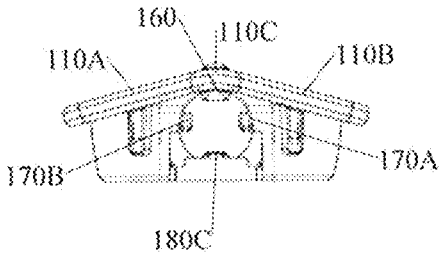
FIG. 13A is a cross-sectional view, taken at line "13A-13A" of FIG. 11A, according to an example embodiment of the present invention.
Figure 13B:
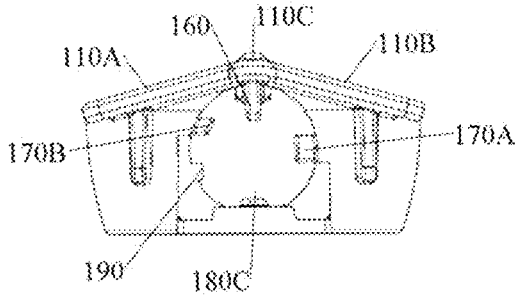
FIG. 13B is a cross-sectional view, taken at line "13B-13B" of FIG. 11B, according to an example embodiment of the present invention.

FIGS. 13A-13B are cross-sectional views, taken at lines "13A-13A" and "13B-13B" of the example embodiments of FIGS. 11A-11B, respectively. More specifically, FIG. 13A illustrates a cross-sectional view of an upper part of the retaining portion 120 of the hang tag 100, which is configured for an SDS-plus drill bit 200. As shown in FIG. 13A (and also FIG. 14A), the ribs 170A and 170B are positioned such that they are configured to engage with the open grooves G1 of the SDS-plus drill bit 200 (FIGS. 2A-2C). In this regard, for example, the ribs 170A and 170B, shown in FIG. 13A, are level with each other to correspond to the open groove pattern of the SDS-plus drill bit 200.

In addition, FIG. 13B illustrates a cross-sectional view of an upper part of the retaining portion 120 of the hang tag 100, which is configured for an SDS-max drill bit 200'. As shown in FIG. 13B (and also in FIG. 14B), the ribs 170A and 170B are positioned such that they are configured to engage with two of the three open grooves G1 of an SDS-max drill bit 200' (FIG. 3A-3C). In this regard, for example, the ribs 170A and 170B, shown in FIG. 13B, are not level with each other, but are positioned to correspond to the open groove pattern of the SDS-max drill bit 200'.

In each of the example embodiments of FIGS. 13A-13B, the ribs 170A and 170B provide the added benefit of being able to hold the drill bit 200/200' in position and provide an additional measure for preventing the drill bit 200/200' from rotating within the hang tag 100. This preventive measure is particularly effective because the ribs 170A and 170B engage with walls of the open grooves G1 that are perpendicular or substantially perpendicular to the longitudinal axis of the hang tag 100, as opposed to the sloped walls of closed grooves G2.

Figure 14A:
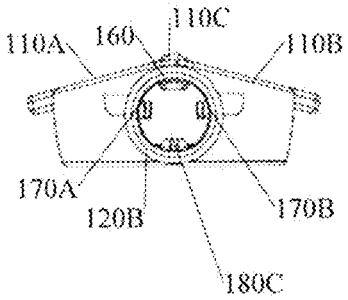
FIG. 14A is a cross-sectional view, taken at line "14A-14A" of FIG. 11A, according to an example embodiment of the present invention.
Figure 14B:
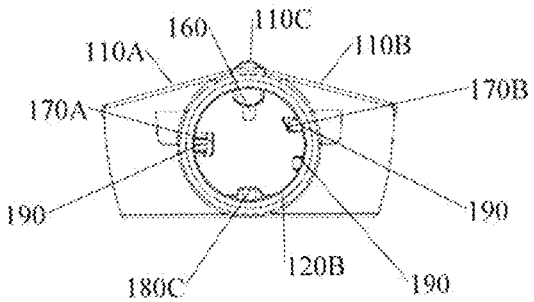
FIG. 14B is a cross-sectional view, taken at line "14B-14B" of FIG. 11B, according to an example embodiment of the present invention.

FIGS. 14A-14B are cross-sectional views, taken at line "14A-14A" and "14B-14B" of the example embodiments of FIGS. 11A-11B, respectively. In this regard, for example, FIGS. 14A-14B illustrate cross-sections of the second cylindrical portion 120B. More specifically, in an example embodiment, the second cylindrical portion 120B is configured to retain a part of the shank of a drill bit 200/200'. In an example embodiment, the second cylindrical portion 120B includes a relatively smooth interior surface that enables an object to be easily inserted therein. In this regard, for example, the second cylindrical portion 120B, shown in FIG. 14A, includes a relatively smooth interior surface such that an SDS-plus drill bit 200 can be easily inserted therein.

Alternatively, in another example embodiment, the second cylindrical portion 120B includes an interior surface with axially aligned rails 190, which are structured to fit within and correspond to the open grooves G1 of a shank of a drill bit 200'. More specifically, in an example embodiment, the rails 190 extend along a height direction of an interior surface of the second cylindrical portion 120B (i.e., along the y-axis). Also, the rails 190 are structured such that the drill bit 200', via its pattern of open grooves G1, is properly aligned and positioned in the hang tag 100. In addition, when the rails 190 are fitted into the open grooves G1 of the shank of the drill bit 200', the rails 190 are structured to securely hold the drill bit 200' and prevent a rotation of the drill bit 200'. In this regard, for example, FIG. 14B illustrates an example embodiment in which the second cylindrical portion 120B includes rails 190 corresponding to the open groove pattern of an SDS-max drill bit 200', thereby enabling the SDS-max drill bit to be guided into the retaining portion 120 and held therein.

Specifically, while elements 160, 170A, and 170B, for example, provide a force counter to a rotating motion at a top portion of the drill bit 200/200' when rotation is attempted, the rails 190 similarly provide a force counter to the rotating motion at a lower portion of the drill bit 200/200'. This combination prevents a twisting motion that might otherwise allow the drill bit 200/200' from breaking free of the elements 160, 170A, and 170B or of the rails 190.

FIG. 15 illustrates a rear view of the apparatus of the second configuration according to an example embodiment. More specifically, in this example, the hang tag 100 is illustrated together with an SDS-max drill bit 200'. As shown in FIG. 15, the supporting structures 175A and 175B, a stopper 185 (described below), the opening 180A, and the opening 180B are visible from the rear view. In addition, in an example embodiment, these features are also provided on an apparatus including an SDS-plus drill bit 200.

In an example embodiment, the body portion 110 includes a stopper 185 on a rear side of the hang tag 100. The stopper 185 is configured to prevent an object, such as drill bit 200/200', from moving beyond the position of the stopper 185 in the vertical or longitudinal direction (parallel to the y axis). In an example embodiment, the stopper 185 is a projection, which is structured to provide an abutment surface for a top portion of the drill bit 200/200', thereby preventing a continued longitudinal motion of the drill bit 200/200' towards a top of the hang tag 110, to ensure that the drill bit 200/200' is properly positioned within the hang tag 100. In this regard, the stopper 185 is particularly beneficial for a hang tag 100 configured for an SDS-max drill bit.

In an alternative example embodiment, the stopper 185 is omitted. For instance, the stopper 185 can be an optional feature particularly in the case of a hang tag 100 configured for an SDS-plus drill bit 200, since a thickness of the SDS-plus drill bit 200 increases slightly along its shank toward its drill point, which would help prevent the continued longitudinal movement of the SDS-plus drill bit 200 within the hang tag 100 once the end face 206 reaches the upper end of the first cylindrical portion 120A after having been slid through the second cylindrical portion 120B, as such increased thickness of the drill bit 200 provides a frictional force against the interior wall of the second cylindrical portion 120B.

As discussed above, the hang tag 100 includes a number of advantageous features. For example, the hang tag 100 includes a body portion 110, which is angled in a manner that provides enhanced rigidity and enhanced label viewing. The hang tag 100 is also structured such that a security device may be securely attached while also being hidden from view.

In addition, as discussed above, according to the first set of configurations, the hang tag 100 includes a retaining portion 120 that includes a number of structural features that are configured to provide a secure hold on an object, such as a drill bit 200/200', and, according to example embodiments (e.g., FIGS. 1A-1B and 4A-9B) of the first set of configurations, the retaining portion 120 includes components that enhance engagement and prevent rotation of the object, for example, by one or more prongs 135A and 135B and by an anti-rotation and holding mechanism (e.g., including guide 155 and/or rail 190) that assist in securely guiding and holding the object in the hang tag 100. In addition, the retaining portion 120 includes components, such as first and second ribs 140A/140A' and 140B/140B', which provide support to the prongs 135A and 135B in the event that the prongs 135A and 135 are forced downwards along the longitudinal direction.

Alternatively, as discussed above, according to the second set of configurations, the hang tag 100 includes a retaining portion 120 that includes a number of structural features that are configured to provide a secure hold on an object, such as a drill bit 200/200', and, according to example embodiments (e.g., FIGS. 10-15) of the second set of configurations, the retaining portion 120 includes components that enhance engagement, rotation prevention, and clamping of the object, for example, by one or more of the protrusion 160 that extends from the body portion 110 to the retaining portion; the projection 180D that ensures that the protrusion 160 is clamped and engaged with the object when provided therein; and an anti-rotation and holding mechanism (e.g., including rib 170A, rib 170B, and/or rails 190) that assist in securely guiding and holding the object in the hang tag 100.

The hang tag 100 additionally enables various portions of an object, while held in the hang tag 100, to be exposed and viewed. For example, the hang tag 100 includes a first cylindrical portion 120A with a front side opening 130 that enables an individual to view that front section of the object held therein. In addition, the hang tag 100 includes an opening 180A that enables the corresponding rear sections of the object to be viewed without having to forcibly remove the object from the hang tag 100. The hang tag 100 may further include through-holes 145A and 145B, as shown in FIGS. 9A-9B, or an opening 180B, as shown in FIG. 15, such that the object is also viewable at those corresponding parts.

The embodiments described above, which have been shown and described by way of example, and many of their advantages will be understood by the foregoing description, and it will be apparent that various changes can be made in the form, construction and arrangement of the components without departing from the disclosed subject matter or without sacrificing one or more of its advantages. Indeed, the described forms of these embodiments are merely explanatory. These embodiments are susceptible to various modifications and alternative forms, and the following claims are intended to encompass and include such changes and not be limited to the particular forms disclosed, but rather to cover all modifications, equivalents, and alternatives falling with the spirit and scope of this disclosure.

That is, the above description is intended to be illustrative, and not restrictive, and is provided in the context of a particular application and its requirements. Those skilled in the art can appreciate from the foregoing description that the present invention may be implemented in a variety of forms, and that the various embodiments may be implemented alone or in combination. Therefore, while the embodiments of the present invention have been described in connection with particular examples thereof, the general principles defined herein may be applied to other embodiments and applications without departing from the spirit and scope of the described embodiments, and the true scope of the embodiments and/or methods of the present invention are not be limited to the embodiments shown and described, since various modifications will become apparent to the skilled practitioner upon a study of the drawings, specification, and following claims. For example, components and functionality may be separated or combined differently than in the manner of the various described embodiments, and may be described using different terminology. These and other variations, modifications, additions, and improvements may fall within the scope of the disclosure as defined in the claims that follow.

What is claimed is:

1. A hang tag for an object, the hang tag comprising:

a main body including a ridge that (a) extends along a longitudinal axis from a top of the main body to a bottom of the main body, (b) divides the main body into a first portion at a first side of the ridge and a second portion at a second side of the ridge, and (c) is a vertex of an obtuse angle formed at an exterior surface of the main body, a retaining portion into which a portion of the object is insertable and including (a) prongs configured to, when the portion of the object is inserted in the retaining portion, engage with side grooves in opposite sides of the object to prevent the object from rotating, and (b) ribs configured to support the prongs when the prongs are forced towards the ribs, wherein:

the vertex is tangent to a plane that is parallel to a surface of the retaining portion, the first portion extends away from the plane by a first acute angle, and the second portion extends away from the plane by a second acute angle.

2. The hang tag of claim 1, wherein:

the retaining portion is structured to receive a drill bit as the object; and the prongs fit within the side grooves of the drill bit, each of the side grooves being a closed groove on a shank of the drill bit, the closed groove being a depressed region of an outer radial surface of the shank of the drill bit, an entire perimeter of the depressed region being surrounded by a raised region of the outer radial surface of the shank of the drill bit.

3. The hang tag of claim 1, further comprising:

at least one guide member protruding from the surface of the retaining portion, the at least one guide member being configured to mate with at least one other groove of the object.

4. The hang tag of claim 3, wherein:

the retaining portion includes a first cylindrical portion and a second cylindrical portion;

each of the first cylindrical portion and the second cylindrical portion is configured to receive the object;

an orientation of the first cylindrical portion is approximately perpendicular to an orientation of the second cylindrical portion; and the at least one guide member is positioned at least partly within at least one of the cylindrical portions.

5. The hang tag of claim 1, further comprising:

a protrusion that extends from a bottom of the ridge of the main body and into the retaining portion.

6. The hang tag of claim 1, wherein an angle measure of the first acute angle is equal to an angle measure of the second acute angle.

7. The hang tag of claim 1, further comprising:

a recess structured to receive a security sensor, wherein an entirety of the recess is positioned within the first portion or the second portion.

8. The hang tag of claim 1, further comprising:

a first support member that supports a first portion of the main body in relation to the retaining portion; and a second support member that supports a second portion of the main body in relation to the retaining portion.

9. A hang tag for an object, the hang tag comprising:

a main body including a ridge that extends along a longitudinal axis from a top of the main body to a bottom of the main body and that divides the main body into a first portion at a first side of the ridge and a second portion at a second side of the ridge; and a retaining portion into which a portion of the object is insertable and including (a) prongs configured to, when the portion of the object is disposed in the retaining portion, engage with side grooves in opposite sides of the object to prevent the object from rotating, (b) ribs configured to support the prongs when the prongs are forced towards the ribs, and (c) a protrusion extending from a bottom of the ridge of the main body and into the retaining portion, the protrusion being structured to cover a corresponding part of the object when the object is disposed within the retaining portion.

10. The hang tag of claim 9, wherein:

the object is a drill bit, and the protrusion is wider than a groove of the drill bit such that the protrusion provides an abutment surface for the drill bit when the drill bit moves towards the protrusion.

11. A hang tag for an object, the hang tag comprising:

a main body including a ridge that extends along a longitudinal axis from a top of the main body to a bottom of the main body and that divides the main body into a first portion at a first side of the ridge and a second portion at a second side of the ridge; and a retaining portion into which a portion of the object is insertable and including (i) a first structure with an inner region that includes (a) prongs configured to, when the portion of the object is inserted in the retaining portion, engage with side grooves in opposite sides of the object to prevent the object from rotating, and (b) ribs spaced from the prongs along the longitudinal axis and configured to support the prongs when the prongs are forced towards the ribs, and (ii) a second structure spaced from the ribs along the longitudinal axis, the second structure surrounding a periphery of a corresponding part of the object when the object is disposed within the retaining portion.

12. The hang tag of claim 11, wherein:

the first structure is a first cylindrical portion, the second structure is a second cylindrical portion;

an orientation of the first cylindrical portion is approximately perpendicular to an orientation of the second cylindrical portion.

13. The hang tag of claim 11, wherein the first cylindrical portion includes (a) a surface as a base and (b) an opening that is positioned opposite to the surface and exposes a corresponding part of the object when held in the retaining portion.

14. The hang tag of claim 13, further comprising:

a guide member protruding from at least the surface of the first cylindrical portion, the guide member being configured to mate with a groove of the object.

15. The hang tag of claim 11, further comprising:

a rail protruding from an interior surface of the second structure, the rail being configured to engage with a groove of the object to prevent a rotation of the object when the object is disposed within the second structure.

* * * * *